United States Patent [19]

Kerttula

[11] Patent Number: 4,692,215

[45] Date of Patent: Sep. 8, 1987

[54] APPARATUS FOR CONVEYING A WEB LEAD-IN STRIP IN A PAPER MACHINE

[75] Inventor: Reima Kerttula, Jyväskylä , Finland

[73] Assignee: Valmet Oy, Finland

[21] Appl. No.: 751,014

[22] Filed: Jul. 2, 1985

[30] Foreign Application Priority Data

Jul. 5, 1984 [FI] Finland ..... 842711

[51] Int. Cl.[4] ..... D21F 1/42

[52] U.S. Cl. ..... 162/289; 162/193; 162/255; 162/286

[58] Field of Search ..... 162/193, 202, 207, 255, 162/297, 286, 289; 34/114, 116, 117; 226/91, 97

[56] References Cited

U.S. PATENT DOCUMENTS

| | | | |
|---|---|---|---|
| 3,355,349 | 11/1967 | Devlin | 162/193 |
| 3,756,912 | 9/1973 | Rooney | 162/255 |
| 4,501,643 | 2/1985 | Kiuru | 162/193 |
| 4,551,203 | 11/1985 | Eskelinen | 162/207 |

FOREIGN PATENT DOCUMENTS

| | | | |
|---|---|---|---|
| 2636887 | 3/1977 | Fed. Rep. of Germany | 162/193 |

*Primary Examiner*—Peter Chin

*Attorney, Agent, or Firm*—Steinberg & Raskin

[57] ABSTRACT

Apparatus for conveying a web lead-in strip in a paper machine in a controlled manner includes a conveyor belt arranged in a loop around one or more reversing rolls, the conveyor belt being formed of an air-pervious fabric. Devices are arranged within the loop of the conveyor belt for creating a dynamic vacuum on the belt run on which the lead-in strip is conveyed to cause the lead-in strip to adhere to that belt run. The devices comprise guide plates associated with respective air distributing headers which direct air jets over the guide plates. The guide plates are arranged substantially parallel to the plane of the conveying run of the belt in a manner such that a dynamic vacuum is created which acts on the conveying run to cause the lead-in strip of the web to adhere to the conveying run of the conveyor belt. The apparatus is lightweight and compact in construction and permits the lead-in procedure to be automated to such an extent that no manual operations are required.

10 Claims, 7 Drawing Figures

APPARATUS FOR CONVEYING A WEB LEAD-IN STRIP IN A PAPER MACHINE

BACKGROUND OF THE INVENTION

This invention relates generally to paper making machines and, more particularly, to apparatus for facilitating the conveyance of a lead-in strip of a web.

When the operation of a paper machine is initiated, their, when the paper machine is first started or when the paper machine is restarted, such as after a web break, a relatively narrow lead-in strip is cut from the leading end of the web such, for example, as by directing a water spray against the web while it is positioned against a stone cylinder. The narrow lead-in strip, which may for example have a width of about 200 mm, is then manually guided into the web lead-in equipment, such guidance being facilitated by means of air jets. The web lead-in equipment of the drier part of the paper machine conventionally comprises a double rope mechanism arranged so that each drier section of the drier part is equipped with ropes which run over pulleys installed near the ends of the drying cylinders. Although the web lead-in strip is normally guided between two ropes, as many as three cooperating ropes or belts have been used in single-wire lead-in arrangements.

In the press part of the paper machine, the web lead-in strip is normally manually pulled to the side of the paper machine between the ropes without the assistance of air jets. This operation can be somewhat dangerous as it must of necessity be performed close to massive rotating machine components. The operation also requires considerable skill.

The difficulties in conveying and guiding the web lead-in strip described above have become more serious as the speeds of paper machines increase. The difficulties are most serious immediately after the press part, in the preliminary drier part, and in the gaps between the drier sections of the dryer part.

An arrangement for controlling the conveyance and guidance of a web lead-in strip at the drier part of a paper machine is disclosed in U.S. application Ser. No. 653,825 filed Sept. 24, 1984, now U.S. Pat. No. 4,543,160, assigned to the assignee of the instant application. In the arrangement disclosed in said Patent, the web lead-in strip is detached from a cylinder of the press part of the paper machine by means of air jets and is guided by means of additional air jets into contact with the drying wire of the dryer part. Subsequently, air jets are applied to the lead-in strips supported by the drying wire in order to separate the lead-in strip from the drying wire. Substantially immediately thereafter, transverse air jets are directed onto the lead-in strip whereby the lead-in strip is moved into position within the gap formed between the lead-in ropes whereupon the web is carried over the drying cylinders.

Concerning the state of the art relative to the present invention, reference is made to Finnish Pat. No. 57 990 and U.S. Pat. No. 3,355,349. A belt conveyor for a calender or a reel-up for conveying the lead-in strip, or a belt conveyor arranged before the calender are disclosed in these patents. Such known belt conveyor arrangements comprise two reversing rolls and a closed air-pervious belt loop having an upper run which is subjected to a vacuum created by a suction box positioned within the belt loop. The suction box creates a vacuum on the upper run of the belt which holds the lead-in strip in contact with the conveyor belt. A major drawback of these conventional arrangements is that it is difficult to seal the suction box to obtain a sufficient vacuum. Moreover, the suction box is a heavy component having a relatively complicated construction.

With further reference to the state of the art with respect to the present invention, reference is also made to Finnish Pat. No. 62 695 which corresponds to No. DOS-3218306 and U.S. Pat. No. 4,501,643, assigned to applicant's assignee. An arrangement is disclosed in this patent for a cutting and guiding device which comprises guide plates provided with air jet means for guiding and supporting a lead-in strip. A drawback of this known device is that relatively wet paper webs tend to stick to the air jet plates so that the web lead-in operation is not always successful.

SUMMARY OF THE INVENTION

It is an object of the present invention to provide new and improved apparatus for conveying a web lead-in strip in a paper machine.

Another object of the present invention is to provide new and improved apparatus for conveying a web lead-in strip in a paper machine which avoids the drawbacks of conventional arrangements described above.

Still another object of the present invention is to provide new and improved apparatus for conveying a web lead-in strip in a paper machine which is lightweight and compact in construction. These features are quite important as the space which is available in which the apparatus can be arranged without disturbing or affecting the operation of other equipment is quite limited.

A further object of the present invention is to provide new and improved apparatus for conveying a web lead-in strip in a paper machine by means of which the web lead-in operation can be automated so that no manual operations are required. In this manner, the safety of the web lead-in operation is considerably improved.

Briefly, in accordance with the present invention, these and other objects are obtained by providing an air-pervious conveyor belt arranged around reversing rolls to define a conveying run. Air jet equipment is situated within the loop of the conveyor belt and comprise guide plates extending substantially parallel to the plane of the conveying run of the conveyor belt and means for directing air jets over the guide plates to create a dynamic vacuum acting on the conveying run of the belt by which the lead-in strip of the web is caused to adhere to the conveying run of the conveyor belt.

Several important practical advantages are obtained through the use of conveying apparatus in accordance with the invention. The necessity of providing relatively heavy, bulky suction boxes which are difficult to seal is eliminated. Instead, guide plate devices are used which are lightweight and simple in construction. Another important advantage is that a more open and air-pervious fabric can be used for the conveyor belt than was possible heretofore. This is important insofar as the lead-in strip can be detached from the rearward end of the conveying run of the belt conveyor in a more reliable manner as it is possible to apply more efficient web-detaching air jets through a more pervious conveyor belt material. Another important advantage is that the overall pressure distribution, including the vacuum created in the longitudinal or conveying direction of the conveyor belt and the over-pressure at the lower or rearward end of the conveyor belt, can be adjusted, even during the web lead-in operation to an extent which has not been possible heretofore.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
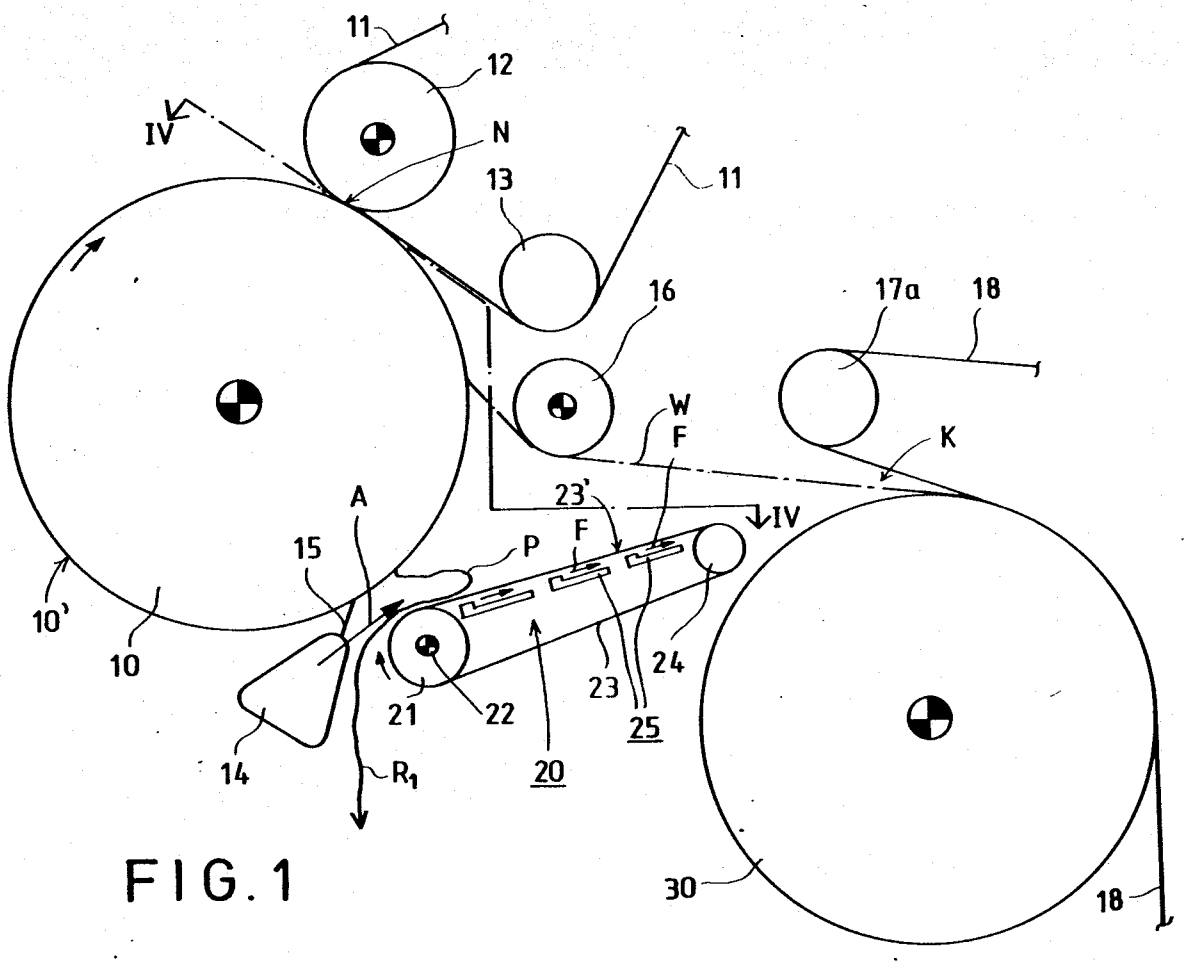
FIG. 1 is a schematic side elevation view of apparatus in accordance with the invention situated beneath a paper guide roll between the press and drier parts of a paper machine.
Figure 2:
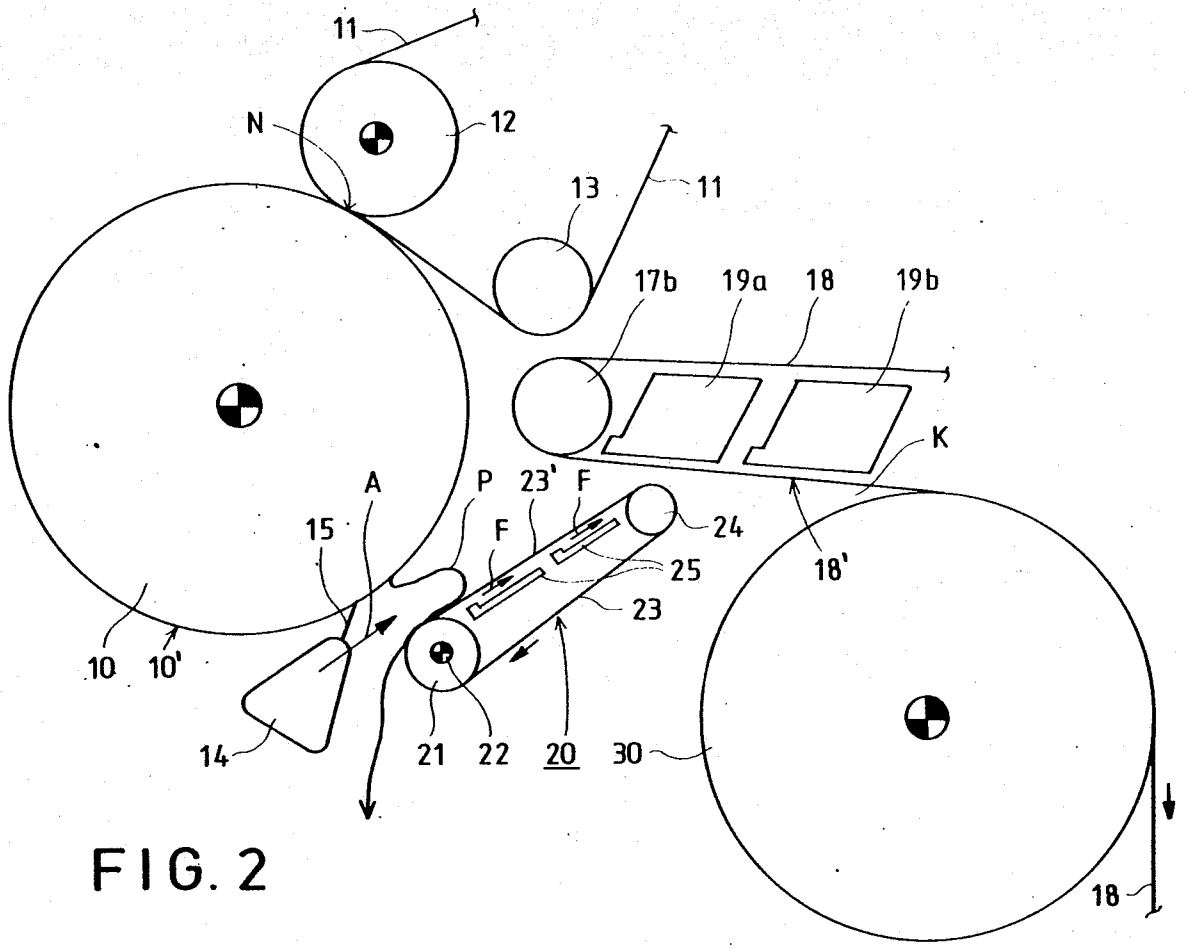
FIG. 2 is a view similar to FIG. 1 showing another embodiment of the invention wherein the space between the press and drier parts is smaller than in the case of the embodiment of FIG. 1.

Referring now to the drawings wherein like reference characters designate identical or corresponding parts throughout the several views, and more particularly to FIGS. 1 and 2, apparatus for conveying a web lead-in strip in accordance with the invention, generally designated 20, are illustrated. The apparatus 20 are shown in use as facilitating the conveyance of the web lead-in strip between the press part and drier part of a paper machine. In both figures, a central press roll 10 having a smooth surface 10' may comprise the central roll of a closed, compact press section, such as a "Sym-Press" press part manufactured by applicant's assignee. The last nip N of the press section is formed between the central roll 10 and a press roll 12. A press belt 11 runs through nip N guided by a guide roll 13. A doctor 14 acts on the surface 10' of the downwardly facing open sector of central press roll 10 to keep the surface clean. The first drying cylinder 30 of the dryer is shown in FIGS. 1 and 2. Cylinder 30 may also comprise a baby or lead-in cylinder or roll.

Referring to FIG. 1, a drying wire 18 of a single-fabric draw is guided by a guide roll **17*a* over cylinder 30. A guide roll 16 is fitted between the press roll 10 and the first drying cylinder 30 to keep the paper web W tightened on the otherwise unsupported draw between the roll 10 and the cylinder 30. The normal run of the full-size paper web W between the press roll 10 and the cylinder 30 is indicated in FIG. 1** in phantom.

Referring to FIG. 2, the guide roll **17*b* of the drying wire 18 is situated relatively closely to the press roll 10. Blow boxes 19*a* and 19*b* are arranged to act on the lower run 18' of drying wire 18 located between the guide roll 17*b* and the drying cylinder 30 for creating a vacuum which acts on the run 18' of dryer wire 18. Reference is made to Finnish patent application No. 83 0422 filed Feb. 7, 1983 for a detailed description of the construction and operation of blow boxes 19*a* and 19*b***.

Figure 4:
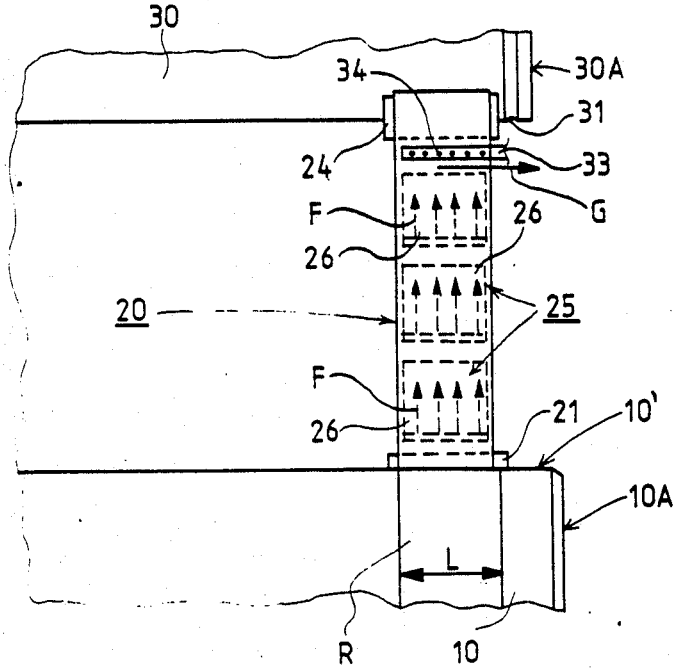
FIG. 4 is a view taken in the direction of lines IV—IV of FIG. 1.

Upon starting the paper machine, or when the paper machine is restarted after a break of web W, a lead-in strip R having a width of about 200 mm is cut from the web such, for example, against press roll 10. After the lead-in strip R is loosened from the surface 10' of roll 10 by the blade 15 of doctor 14, the strip R is guided to a pulper (not shown) located below press roll 10 as indicated by the arrow (FIG. 1) Thereafter, a bag P is formed in the lead-in strip $R_1$ by means of an air jet A applied from the beam 14 of the doctor. The downwardly hanging lead-in strip $R_1$ breaks or is cut by suitable equipment (not shown). The lead-in strip R is then conveyed onwards by means of the conveying apparatus 20 in accordance with the invention into a rope gap K formed between the surface of the cylinder 30 and the conventional lead-in ropes (not shown). A groove 31 in which the lead-in ropes run is provided near the end 30A of cylinder 30 as seen in FIG. 4.

Conveyor apparatus 20 for conveying the lead-in strip R in accordance with the invention comprises reversing rolls 21 and 24 around which a fabric loop 23 runs. The fabric loop 23 is constructed of moderately permeable fabric material, such as net-type plastic wire. The axial length of the rolls 21 and 24 and the width of the fabric 23 are substantially equal to the width L of the lead-in strip R as best seen in FIG. 4. The reversing roll 21 is provided with its own adjustable drive and is preferably driven at a speed which is slightly higher than the speed of press roll 10.

One or more air jet devices 25 are arranged within the fabric loop 23 in accordance with the invention. In the embodiment of FIG. 1, three such air jet devices 25 are utilized while in the embodiments of FIGS. 2 and 5A, two and four such devices are utilized, respectively. The air jet devices 25 are arranged consecutively, i.e., one after the other as seen in the figures.

Figure 3A:
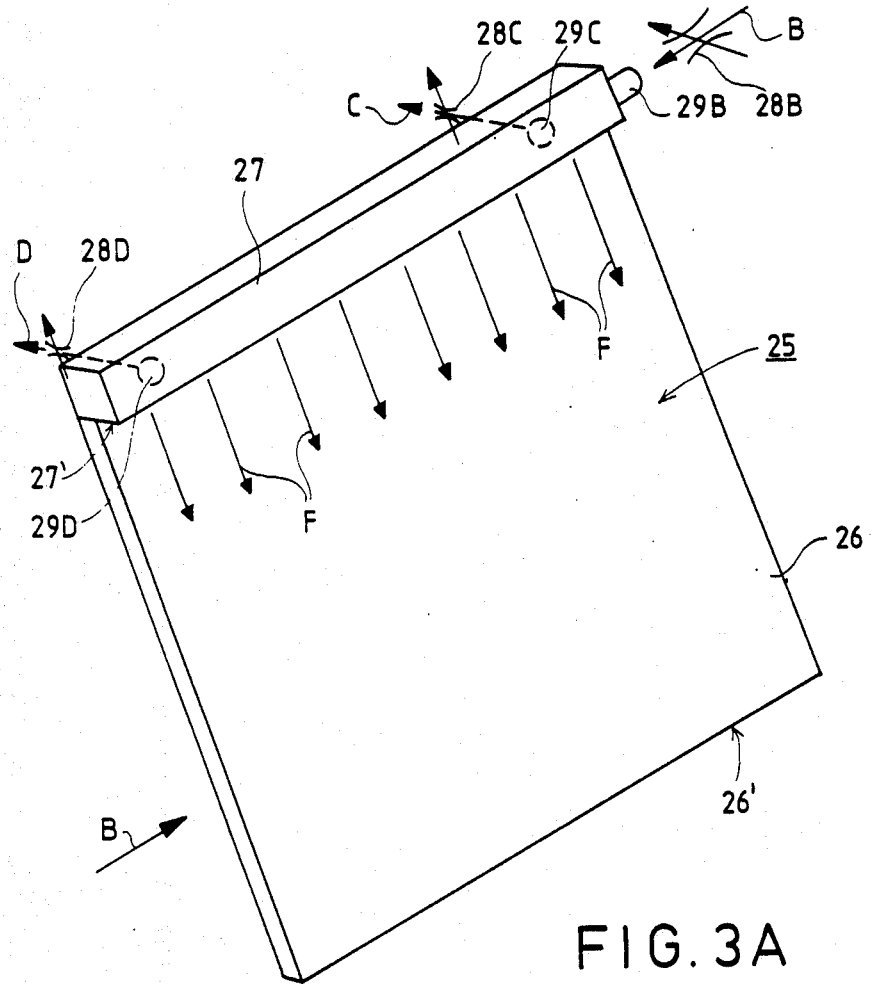
FIG. 3A is an axonometric view of an air jet device comprising a component of the invention.
Figure 3B:
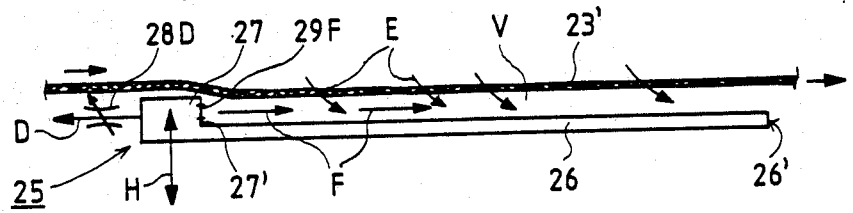
FIG. 3B is a side elevation view of the air jet device illustrated in FIG. 3A in the direction of arrow B and illustrating the relationship between the air jet device and the conveying run of the conveyor belt.

Referring to FIGS. 3A and 3B, each air jet device 25 comprises a guide plate 26 which extends substantially parallel to the upper run 23' of the fabric 23, and an air distributing header or pipe 27 provided at the front or leading edge of the plate 26. The rear edge 26' of the guide plate 26 is free. A plurality of orifices 29F are formed through the front side 27' of the air distributing header 27 through which air jets F are directed over and substantially parallel to the guide plate 26 and into the space V provided between the upper run 23' of fabric 23 and the guide plate 26 as best seen in FIG. 3B. One or more nozzle slots or other suitable air jet forming means may be used in lieu of orifices 29F. Behaving in accordance with Bernouilli's law and the Coanda effect, a dynamic vacuum is created which acts on the upper run 23' of fabric 23 by the air jets F. Due to the presence of the vacuum acting on the inner surface of the conveying run 23' of fabric 23, an air flow, designated E in FIG. 3B, tends to be created through the permeable fabric 23 which causes the lead-in strip R to become adhered to the fabric run 23' so that the conveyor belt carries the lead-in strip R onwards. In other words, atmospheric pressure acting on the web lead-strip R on the fabric run 23' causes the lead-strip R to adhere to the fabric run 23' by virtue of the under-pressure created by the air jet devices 25 as described above.

Referring to FIG. 3A, compressed air, designated B, is supplied to the air distributing headers 27 by inlet pipes 29B. A control valve 28B is provided in the inlet pipe 29B. One end of the air distributing header 27 is closed and a by-pass control valve 28D is provided in the header 27 near to the closed end. Another by-pass control valve 28C is provided in the header 27 near the inlet pipe 29B. The control valve 28C and 28D can be adjusted to produce by-pass air flows C and D which can be adjusted to control the pressure distribution in the transverse direction of the air distribution header 27, i.e., transversely with respect to the traveling direction of the fabric 23 and the web lead-in strip R.

The air jets F discharging from orifices 29F over the guide plates 26 create a vacuum which acts on the upper conveying run 23' of fabric 23. Due to the vacuum action, the lead-in strip R, and initially the bag P of the lead-in strip R, adheres to the upper conveying run 23' of the fabric 23 and is carried thereby to the rearward end of the apparatus 20 where the lead-in strip R is loosened and preferably detached from the conveying run 23' by means of air jets $F_1$ (FIG. 5A) applied by air jet equipment 33, 34 shown in FIGS. 4 and 5A. The air jet equipment comprises a blowpipe 33 having a plurality orifices 34 or equivalent nozzle slot or slots, through which air jets $F_1$ are directed against the inner surface of the fabric 23. The lead-in strip R is detached from the end of the conveying run 23' of belt 23 under the influence of the air jets $F_1$ whereby the strip R can be reliably conveyed to the rope gap K and further on between the ropes in a conventional manner.

The speed of the wire or fabric 23 of the conveying apparatus in accordance with the invention is adjustable by means of the drive 22 of reversing roll 21 in a manner such that the speed which is most advantageous from the point of view of the web lead-in procedure is achieved.

The position of the conveyor means 20 in accordance with the invention is advantageously arranged so as to be adjustable. For example, the reversing roll 21 is preferably articulated with respect to the vertical axis so that the apparatus 20 can be pivoted sideways in the direction of arrow G (FIG. 4). In this manner, the conveyor 20 can be adjusted to direct the lead-in strip R precisely into the rope gap, i.e., into the region of the groove 31 shown in FIG. 4. The conveyor apparatus 20 can also be arranged so as to be vertically adjustable.

Each of the air jet devices 25 is preferably arranged so as to be adjustable in a direction substantially perpendicular to the plane of the conveying run 23' of fabric 23 as designated by the arrow H in FIG. 3B. Indeed, it is preferred that each air jet device 25 be situated a distance Δ from the conveying run 23' of conveyor 23 which is somewhat greater than the distance between the preceding air jet device 25 and conveying run 23'. It may also be desirable to mount the air jet devices so that each can be rotated around a transverse axis in order to provide a capability for adjustment of the vacuum in space V.

Figure 5B:
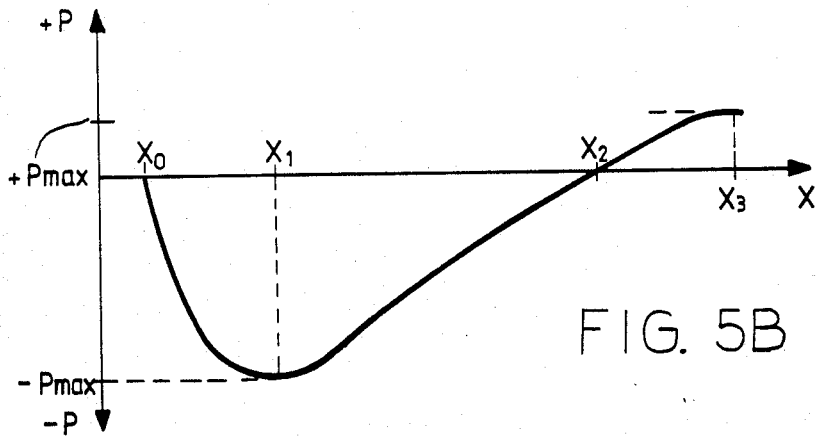
FIG. 5B is a graphical illustration showing the longitudinal pressure distribution acting on the conveying run of the conveyor belt shown in FIG. 5A.
Figure 5A:
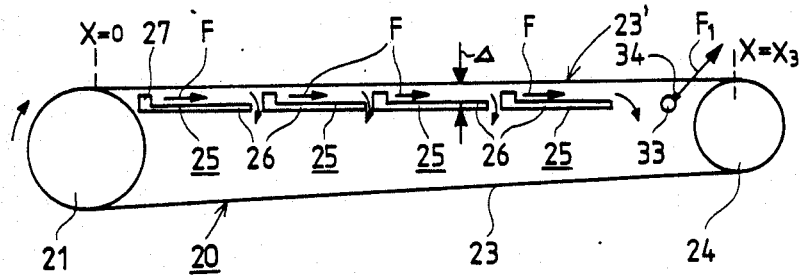
FIG. 5A is a schematic side elevation view of another embodiment of conveyor apparatus in accordance with the invention.

Referring now to FIG. 5B in conjunction with FIG. 5A, the vacuum distribution at the upper run 23' of fabric 23 of the conveying means 20 in accordance with the invention in the longitudinal and conveying direction of the run 23' is shown. The vacuum distribution shown in FIG. 5B corresponds to that achieved by the construction of the apparatus 20 shown in FIG. 5A. Vacuum action is initiated at $X_0$ corresponding to the position of the air distributing header 27 of the first air jet device 25. Thereafter, the vacuum rises to a maximum $-P_{max}$ at $x_1$ which is located at the position of the air distributing header of the second air jet device 25. Thus, the lead-in strip R reliably adheres to the upper run 23' of fabric 23 at the position $X_0$ and accelerates in the x-direction. After the point $x_1$, the level of the vacuum drops because the distance Δ of the air jet devices 25 from the conveying run 23' of belt 23 increases. At the point $x_2$, which is approximately the location of the trailing edge 26' of the guide plate 26 of the last air jet device 25, the vacuum becomes an over-pressure due in part to the ending of the guide plate 26 and the reduction in flow speed, and in part due to the air jets $F_1$. At the point $x_3$ where the conveying run 23' of belt 23 meets reversing roll 24, the over-pressure is at its maximum value of $+P_{max}$. The lead-in strip R is detached from the fabric 23' due to the over-pressure.

The shape of the pressure curve shown in FIG. 5 can be adjusted in the x-direction as required through the adjustment of the positions of the air jet devices 25, and possibly also through the adjustment of the air jets F so that the lead-in strip R can be reliably attached to the fabric 23, accelerate up to the speed of the fabric 23, be reliably held in contact with the fabric 23 and be detached from the fabric 23 at the trailing end of the conveying run 23' under the influence of the over-pressure described above. Such versatile settings and adjustments have not been possible in conventional lead-in strip arrangements.

Comparing the embodiments of FIGS. 1 and 2, it is noted that the open gap between the press roll 10 and the dryer cylinder 30 is longer in the embodiment of FIG. 1 than in that of FIG. 2 so that the conveying apparatus 20 is longer and oriented more towards the horizontal in the case of FIG. 1. In the embodiment of FIG. 2 where the reversing roll **17*b* of the drying wire 18 is situated quite close to the press roll 10, the conveying apparatus 20 can be made shorter and oriented so as to slant upwardly in a manner such that the conveying apparatus will convey the lead-in strip R to that run of the drying wire 18 which is located between the reversing roll 17*b* and the dryer cylinder 30 and which is under the influence of a vacuum created by the blow boxes 19*a* and 19*b*. In the embodiment of FIG. 1, the lead-in strip R is conveyed directly into the rope gap K in connection with cylinder 30 whereas in the embodiment of FIG. 2, the lead-in strip R is conveyed to the lower run 18' of the drying-wire 18 from where the lead-in strip R is guided to the rope gap K formed in connection with cylinder 30**.

As an example of typical dimensions of conveyor apparatus in accordance with the invention, the width of the conveyor belt 23 may be about 300 mm in the case where the width of the lead-in strip R is about 200 mm. The normal distance Δ between the guide plates 25 and the run 23' of conveyor belt 23 is on the order of about 20 mm. The conveyor belt 23 can be formed of material which is highly pervious to air which facilitates detachment of the lead-in strip from the belt run 23' by air jets $F_1$. It is noted that some over-pressure tends to be inherently induced in the nip formed between the belt 23 and the reversing roll 24, such over-pressure being intensified by the air jets F.

Even though the invention has been described above as applied between the press and dryer parts of a paper machine, it will be understood that the invention may be applied equally as well in other parts of a paper machine such, for example, as in the gaps between the sections of the drier parts, between the paper machine and an on-machine calender or between the paper machine and reel-up apparatus.

Conveyor apparatus in accordance with the invention can, if necessary, be mounted on a bracket system that can be moved in a transverse direction to a non-functional position and back to a functional position during a lead-in operation. Such mounting apparatus is known per se.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for conveying a reduced-width lead-in strip of a full width web in a paper machine, comprising:

a conveyor belt arranged in a loop around at least one reversing roll and having a conveying run on which the lead-in strip is conveyed, said conveyor belt being formed of a fabric which is pervious to air; and means situated within said loop of said conveyor belt for creating a dynamic vacuum on said conveying run of said conveyor belt so that the web lead-in strip adheres thereto, said vacuum creating means comprising air jet equipment including a plurality of guide plates situated within said belt loop arranged consecutively with respect to each other proximate to and extending substantially parallel to said conveying run of said conveyor belt, each guide plate being spaced a short distance from the next consecutive guide plate and having a substantially planar guide surface proximate to and extending substantially parallel to said conveying run of said conveyor belt forming a space therebetween, said planar guide surface having a leading edge and a free trailing edge in the running direction of said conveying run, air distributing header means extending substantially tranversely with respect to the running direction of said conveying run and situated substantially at said leading edge of said guide surface, and air jet discharge means formed in said air distributing header means for directing air jets over at least a portion of the length of said guide plate substantially parallel thereto within said space between said guide plate and said conveying run of said conveyor belt; and means for adjustably mounting at least one of said plurality of guide plates with respect to said conveying run of said conveyor belt so that the distance between said guide plate and said conveying run can be varied whereby the distribution of pressure in the running direction of said conveying run can be adjusted.

2. The combination of claim 1 wherein said plurality of guide plates number in the range of between about 2 to 5.

3. The combination of claim 1 further including means rotatably mounting at least one guide plate with respect to an axis transverse to the running direction of said conveying run so that the distance between said guide plate and said conveying run can be varied whereby the distribution of pressure in the running direction of said conveying run can be adjusted.

4. The combination of claim 1 further including means for adjusting the position of said apparatus including said conveyor belt and said air jet equipment laterally to facilitate conveyance of said web lead-in strip into web handling equipment following said conveying apparatus.

5. The combination of claim 1 further including means for adjusting the position of said apparatus including said conveyor belt and said air jet equipment between a first operating position and a second non-operating position.

6. The combination of claim 1 wherein said conveyor belt is arranged around a reversing roll situated at a trailing end of said conveying run thereof, and further including means for creating an over-pressure on said conveying run between a trailing end of a last one of said guide plates in the running direction of said conveying run and said reversing roll situated at said trailing end of said conveying run, whereby the lead-in strip is loosened from the conveyor belt by said over-pressure creating means.

7. The combination of claim 6 wherein said overpressure creating means include means for directing air jets onto said conveying run.

8. The combination of claim 1 wherein the paper machine includes a press part having a press roll, a dryer part having a first dryer cylinder, a web guide roll for guiding the web from said press roll to said first dryer cylinder, and rope means for guiding said web lead-in strip into said dryer part, said rope means forming a rope gap with said first dryer cylinder, and wherein said conveying apparatus is located between said press roll and said first dryer cylinder beneath said web guide roll for conveying the lead-in strip directly into said rope gap.

9. The combination of claim 1 wherein the paper machine includes a dryer part including a first dryer cylinder and a dryer wire of a single-wire draw, said dryer wire passing over said first dryer cylinder and a dryer wire reversing roll, means for applying a vacuum to a run of said dryer wire between said dryer wire reversing roll and said first dryer cylinder, and wherein said conveying apparatus is located to convey the web lead-in strip onto said dryer wire run to which the vacuum is applied.

10. The combination of claim 9 wherein said paper machine further includes rope means for guiding said web lead-in strip into said dryer part, said rope means forming a rope gap with said first dryer cylinder, and wherein said dryer wire run to which the vacuum is applied carries the web lead-in strip into said rope gap.

* * * * *